US005166470A

United States Patent [19]

Stewart

[11] Patent Number: 5,166,470

[45] Date of Patent: Nov. 24, 1992

[54] LOW ENERGY FUSE

[75] Inventor: Ronald F. Stewart, Ayr, Scotland

[73] Assignee: Imperial Chemical Industries plc, London, England

[21] Appl. No.: 744,268

[22] Filed: Aug. 13, 1991

[30] Foreign Application Priority Data

Aug. 13, 1990 [GB] United Kingdom ..... 9017715

[51] Int. Cl.[5] ..... C06C 5/04

[52] U.S. Cl. ..... 102/275.5; 102/275.8

[58] Field of Search ..... 102/275.1, 275.5, 275.8

[56] References Cited

U.S. PATENT DOCUMENTS

| | | | |
|---|---|---|---|
| 3,590,739 | 7/1971 | Persson | 102/275.5 |
| 4,290,366 | 9/1981 | Janoski | 102/202.3 |
| 4,328,753 | 5/1982 | Kristensen et al. | 102/275.5 |
| 4,459,318 | 7/1984 | Hyans | 427/36 |
| 4,607,573 | 8/1986 | Thureson et al. | 102/275.5 |
| 4,757,764 | 7/1988 | Thureson et al. | 102/275.8 |

FOREIGN PATENT DOCUMENTS

| | | |
|---|---|---|
| 0327219 | 8/1989 | European Pat. Off. . |
| 2001739 | 2/1979 | United Kingdom . |
| 2019312 | 10/1979 | United Kingdom . |

*Primary Examiner*—David H. Brown

*Attorney, Agent, or Firm*—Cushman, Darby & Cushman

[57] ABSTRACT

A non-electric low energy fuse comprises plastics tubing within which there is provided a core loading of mixed particles which are reactive or detonable to provide signal transmission means wherein the plastics tubing is an extruded tubing and has an outer skin of a hydrophilic polymer to enhance the oil resistance of the fuse.

11 Claims, 1 Drawing Sheet

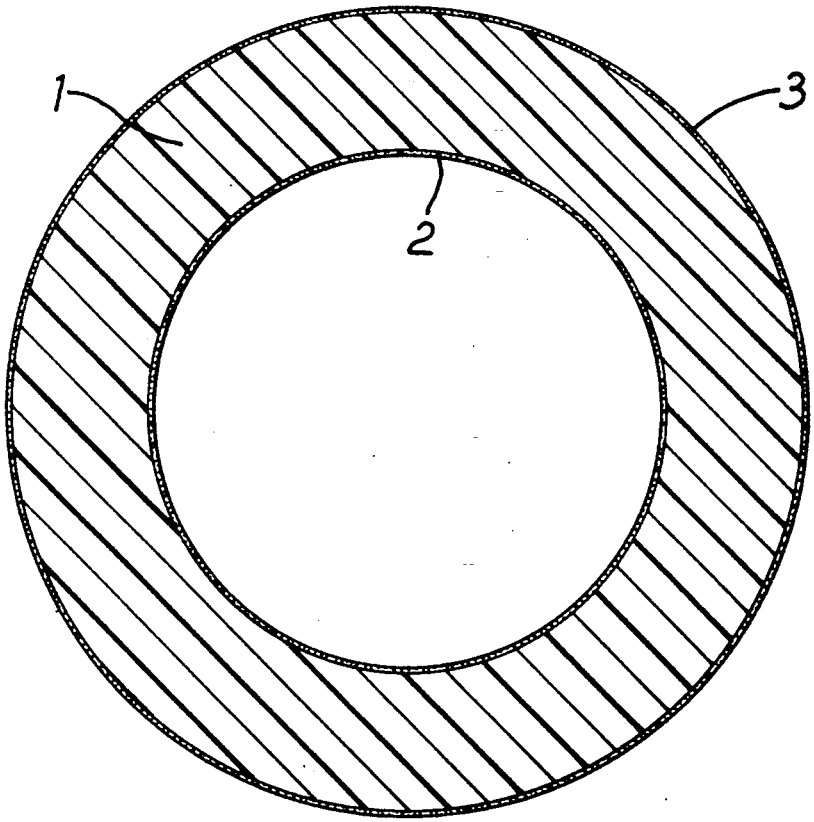
1
2
3

LOW ENERGY FUSE

This invention relates to non-electric low-energy fuses, that is to say, transmission devices in the form of elongate plastics tubing housing reactive or detonable particulate substances at a core loading sufficiently low for there to be no cross-initiation of a similar tube placed alongside (or lateral direct initiation of a surrounding commercial emulsion blasting explosive) when such a device is fired. Ordinarily the core material detonates but in some types rapid deflagration or pyrotechnic reaction suffices as when the tubing is connected to a detonator within which a deflagration to detonation transaction occurs. The signal transmission tubing is itself initiated by an electric cap, a non-electric detonator, an electric discharge device or indeed by any other means capable of initiating the required self-sustaining reaction or detonation of the core material. A favoured type of low energy fuse is the so-called shock tube or signal tube as described in, and cross-referenced in, European Patent Specification No. 327219 (ICI) which corresponds to U.S. patent application Ser. No. 07/587,411. Another distinct class of low-energy fuse is that described in U.S. patent specification No. 4,290,366 (Atlas Powder Company). The contents of these prior specifications and their references are hereby incorporated by reference herein, in their entirety.

The mining, quarrying and construction industries who are the principal users of commercial explosives and accessories and are continually extending the frontiers of their operations into new situations that challenge the reliability of current accessories. Of present relevance is the trend towards increasing use of emulsion explosives and ANFO and heavy ANFO blasting agents, the deployment of non-electric low-energy fuse initiation down-hole as well as on the surface as inter-hole link-ups, coupled with long sleep times (that is the periods of time when the fuse is in contact with the explosive before firing). Commonly the hydrocarbon fuel phase of such explosives is an oil or a petroleum fraction such as diesel, and invariably the plastics from which transmission tubes have been formed have been wholly or mainly of polyethylene (e.g. LLDPE) or a related (co)polymer in which the back-bone chain is a polyethylene and the chain carries side substituents which may be hydrocarbyl or functional groups such as carboxyl and its salt and ester derivatives (e.g. 'Surlyns'). All such polymers are prone to ingress of hydrocarbons of the explosive's fuel oil phase when in prolonged contact therewith. This is so to a greater or lesser extent depending upon the nature of those hydrocarbons, the chemical and physical structure of the polymer of the transmission tubing, and the temperature of the fuel phase (as when an emulsion explosive is loaded hot). Even surface transmission tubing may be in prolonged contact with oil where there is spillage of emulsion explosive or engine oils, and this too may become hot in many of the inhospitable environments in which blasting operations take place.

The Applicants have contrived mis-fires of non-electric transmission devices of the types above-described attributable to penetration of deleterious amounts of hydrocarbons into the interior core of the transmission tubing after prolonged contact.

FIG. 1 shows a cross-section through the tube wall (1) with an inner dusting of reactive material (2) and an outer surface coating (3).

This invention provides an improved plastics transmission tubing for use as a low-energy fuse. The tube forming plastics material may be equivalent to any of the currently used plastics which are susceptible to oil penetration over an extended period of time of being in contact therewith e.g. wholly or predominantly made from addition polymers such as a polyolefin or derivatised polyolefin of the kinds hereinbefore described or another oil absorbing plastics material e.g a condensation polymer such as polyamide or polyester. Such tubing contains as a central core, a detonable signal transmitting particulate material (such as loose, consolidated, bound and/or thread/filament carried material). According to the invention the tubing so obtained is subjected to further treatment comprising applying an outer skin of a hydrophilic polymer, preferably following a surface treatment to improve the application of said skin and its retention thereafter.

As a result of this hydrophilic outer skin, the penetration rate of hot fuel oil, such as diesel, is reduced and therefore the operational life (sleep time) of the transmission tubing is extended. According to our research to date tubing having a polyvinyl alcohol skin has been found to have an operational life of about 2.5 times more than a similar tubing lacking such a skin.

Polyvinyl acetate is also suitable as an outer skin, and it is considered most compatible hydrophilic polymers would be similarly applicable for this purpose. The term "polymer" is to be understood as embracing both homo- and co-polymers.

The skin can be formed by painting or spraying the hydrophilic polymer onto the transmission tubing or co-extruding it therewith as convenient considering the nature of the selected hydrophilic polymer. Coating by immersion of the tubing in a melt of a hydrophilic polymer in a batch process or controlled continuous passage through such a melt would be an alternative option. Before application of the skin, it may be necessary to pre-treat the outer surface of the tubing with a cleaning agent such as chromic acid, or to subject it to heat treatment to improve the application of the skin to the tube. Alternatively a compatible adhesion promoter may be applied to the tube. A vinyl acetate-ethylene reagent may be usefully applied to provide a tie layer or binder on the extruded tube where a low density polyethylene is utilised as the tube forming plastics material and polyvinyl acetate or polyvinyl alcohol is used as the protective skin. Polyethylene is regarded as lacking tack and it is considered that any reagent which can impart a degree of tack to the tube exterior surface should improve the subsequent application of the hydrophilic protective skin. However a preliminary test using one commercially available "tacky" reagent — polyethyleneimine was not encouraging.

The invention also provides a method of manufacturing a signal transmission tubing for use as a low energy fuse, the method comprising extruding a plastics tubing from a melt, optionally treating the extruded tube to improve surface keying properties and applying a hydrophilic polymer thereto to thereby enhance the oil resistance of the fuse.

According to a further aspect of the invention there is provided a method of extending the operational life of a transmission tubing for use as a low energy fuse which will be in contact with hot fuel oil such as diesel, the method comprising forming a transmission tubing of which the plastics material is wholly or predominantly a polyolefin or a derivatised polyolefin of the kinds above described (but may also be another oil absorbing plastic such as polyamide or polyester) and which contains in its central core a reactive signal transmitting particulate substance (such as loose, consolidated, bound or thread/filament carried material), wherein a skin of a hydrophilic polymer is applied to the outer surface of the tubing.

This outer skin of hydrophilic polymer has been found to be capable of giving a substantially extended operational life to the transmission tube.

In an example of the invention, a polyethylene transmission tube was constructed as follows.

A blend of 85% linear low density polyethylene (LLDPE) and 15% low functionality (2%) ethylene-vinyl acetate (EVA) was extruded by a Battenfelder extruder (5.0 cm diameter, 24:1 l/d metering screw), through a 3.0 cm outer die and a 1.4 cm inner mandrel to form a transmission tubing. The melt was subjected to a 15:1 drawdown over 25 cm through a 7.6 mm diameter sizing die and processed as known per se in the art. The large tube dimensions were about 7.6 mm outer diameter (O.D.) extruded at a rate of about 5 m per minute. After stretching, the tube size was about 3 mm O.D. and produced at a rate of 45 m per minute. A reactive/detonable core mixture comprising explosive powder (HMX/Al) was added to the large tube at a rate sufficient to give a final core load of about 20 mg/m (4.4 $g/m^2$ of internal area). The tensile strength of this tube was about 140 $N/m^2$. A break load of 80 kg was required at an extension of 160%. The outer surface of the tubing was cleaned with chromic acid and a skin of polyvinyl alcohol painted thereon. The finished/-protected tubing was then immersed in hot diesel at 80° C. for 70 hours after which it was successfully detonated. Further trials simulating abrasion to the tubing showed successful testing after 336 hours immersion in diesel at 50° C.

Instead of chromic acid treatment, a preliminary heat treatment by application of hot air to the tubing before applying the skin resulted in sample tubings which survived 744 hours immersion in diesel and detonated in each case.

Optionally an adhesion promoter or binder such as Vinamul 3305 (Trade Mark of Vinamul Ltd. for an ethylene/vinyl acetate copolymer) may be applied before application of the polyvinyl alcohol or polyvinyl acetate. A similar tubing as described above but having such a binder applied before applying the top coat of polyvinyl acetate was tested by immersion in diesel for 600 hours and it was found that 7 out of 10 samples passed this test. Subjecting the same material to abrasion testing and immersion in diesel showed encouraging results beyond 168 hours.

The mixed particles which are reactive or detonable to provide for signal transmission may be selected from a variety of reagents known per se in the field of pyrotechnics and would include oxidisers such as perchlorates, permanganates and peroxides; secondary high explosives such as PETN, RDX, HMX, TNT, dinitroethylurea; and tetryl and metal/quasi metal fuels such as aluminium and silicon.

It will be appreciated that the core loading will be variable depending on the sleep time field conditions, and strength required but typically it will be in the range of 15 to 25 $mgm^{-1}$.

Of course the temperature (and therefore penetration) of the fuel used in the field will vary considerably (from say 25° C. to 70° C.) and therefore this should be borne in mind when constructing a low energy fuse of the invention which must have a specified minimum sleep time.

The invention also extends to low-energy fuse assemblies comprising delay elements and/or detonators connected to one or both ends of the transmission tubing as described hereinbefore.

What is claimed is:

1. A non-electric low energy fuse formed from plastics tubing in which there is provided a core loading of mixed particles which are reactive or detonable to provide for signal transmission wherein the plastics tubing has an outer skin of a hydrophilic polymer to enhance the oil resistance of the fuse.

2. The non-electric low energy fuse of claim 1 wherein the plastics tubing is made from a polymer selected from the group consisting of condensation polymers and copolymers thereof.

3. The non-electric low energy fuse of claim 2 wherein the plastics tubing comprises a polymer selected from the group consisting of polyamides, polyesters and copolymers thereof.

4. The non-electric low energy fuse of claim 1 wherein the plastics tubing is extruded from a polymer selected from the group consisting of addition polymers and copolymers.

5. The non-electric low energy fuse of claim 4 wherein the plastics tubing comprises a polymer selected from the group consisting of polyolefin(s), branched polyolefin(s), polyolefin(s) having functional group side substituents and derivatives thereof, and copolymers thereof.

6. The non-electric low energy fuse of any one of claims 1 to 5 wherein the hydrophilic polymer is selected from the group consisting of polyvinyl acetate and polyvinyl alcohol.

7. The non-electric low energy fuse of claim 6 wherein a compatible adhesion promoter is present between the hydrophilic polymer skin and the plastics tubing.

8. The non-electric low energy fuse of claim 7 wherein the plastics tubing is extruded from a polyethylene and the compatible adhesion promoter is a heat reactivated cross-linked vinyl acetate-ethylene copolymer.

9. The non-electric low energy fuse of claim 1 wherein the form of the core loading is selected from the group consisting of loose, consolidated, bound and thread/filament carried material.

10. The non-electric low energy fuse of claim 9 wherein the amount of core loading is from 15 to 25 $mgm^{-1}$.

11. A non-electric low energy fuse formed from an extrudable blend of about 85% linear low density polyethylene and about 15% ethylene vinyl acetate copolymer into a tube in which there is provided a core loading of about 20 mg/m of a reactive/detonable mixture comprising HMX explosive and aluminium particles, and having an outer skin of polyvinyl alcohol to enhance the oil resistance of the fuse.

* * * * *